United States Patent [19]

Johnson

[11] Patent Number: 4,802,354

[45] **Date of Patent: * Feb. 7, 1989**

[54] HIGH SECURITY PIN TUMBLER LOCK

[75] Inventor: Gale Johnson, Northbrook, Ill.

[73] Assignee: Fort Lock Corporation, River Grove, Ill.

[ * ] Notice: The portion of the term of this patent subsequent to Jan. 5, 2005 has been disclaimed.

[21] Appl. No.: 70,924

[22] Filed: Jul. 7, 1987

Related U.S. Application Data

[63] Continuation-in-part of Ser. No. 3,813, Jan. 16, 1987, Pat. No. 4,716,749.

[51] Int. Cl.[4] ..... E05B 27/08

[52] U.S. Cl. ..... 70/491; 70/378; 70/419

[58] Field of Search ..... 70/363, 376, 377, 378, 70/419

[56] References Cited

U.S. PATENT DOCUMENTS

| | | | |
|---|---|---|---|
| 4,041,739 | 8/1977 | Merovrio | 70/363 |
| 4,546,629 | 10/1985 | Hwang | 70/363 |
| 4,716,749 | 1/1988 | Johnson | 70/363 |

*Primary Examiner*—Robert L. Wolfe

*Attorney, Agent, or Firm*—Leydig, Voit & Mayer

[57] ABSTRACT

An improved, highly pick-resistant tumbler lock construction incorporates at least one of the rear face of the driver sleeve or the front face of the tumbler sleeve with a plurality of notches. Each notch surrounds a driver or tumbler axial bore so as to provide at the trough of the notch a false shear plane while the crest of the notch portion of the tumbler and driver sleeve forms a plane to fixedly support two relatively thin discs which form the true shear plane. The discs include annularly spaced bores corresponding to the tumbler and driver sleeve bores. Thus when attempting to pick the lock, and the driver and tumbler pins are at the notched false shear plane, the driver sleeve will not be able to turn because the pins will be caught in the lower part of the notch. Several of the driver pins and the tumbler pins are also provided with annular grooves which, in combination with the undercuts on the spindle and tumbler sleeve, accentuate the false feel effect in such a way that the false feel of the shear plane is provided at different inwardly extending positions of the pins, thereby making it extremely difficult to determine when a particular tumbler pin has been precisely positioned at the shear plane.

14 Claims, 2 Drawing Sheets

FIG. 1
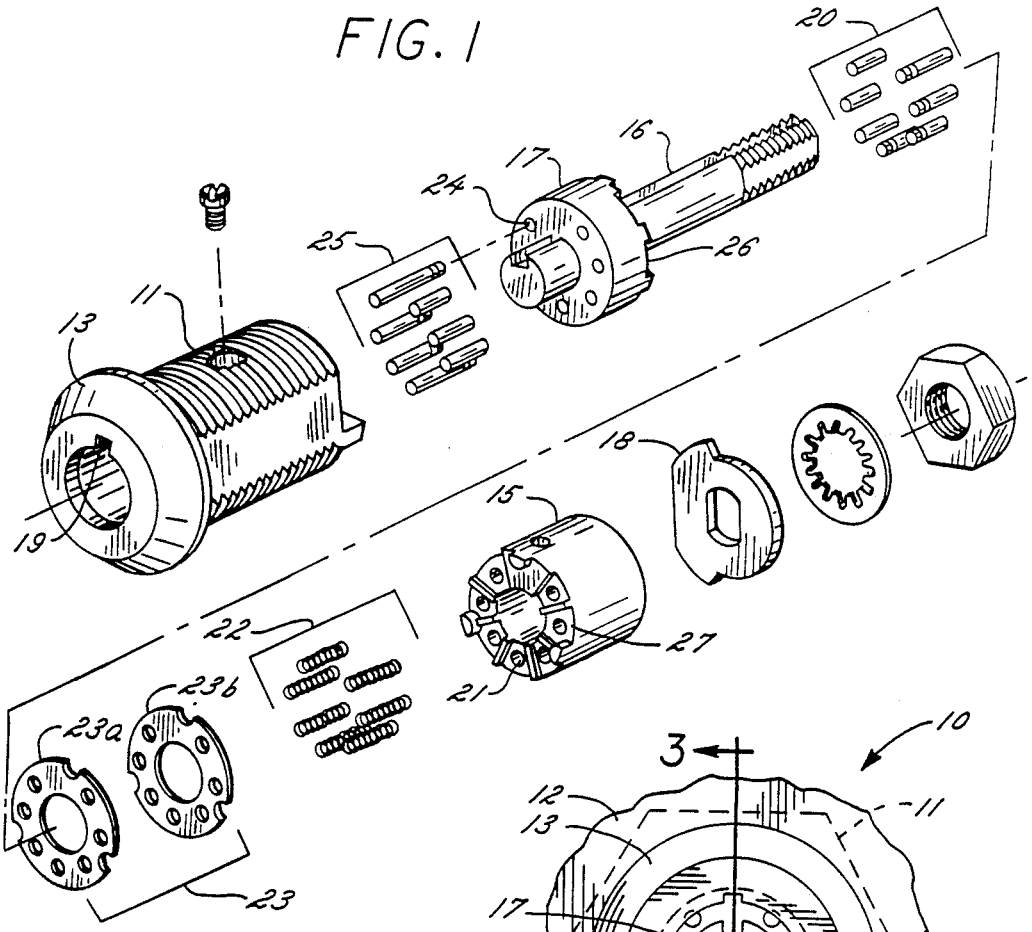
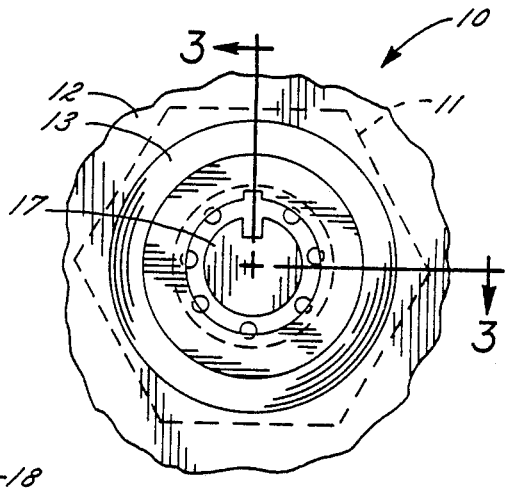
FIG. 2
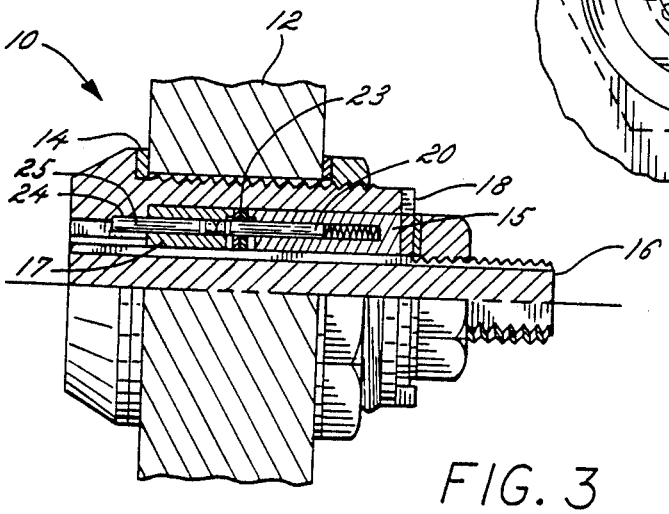
FIG. 3

HIGH SECURITY PIN TUMBLER LOCK

CROSS REFERENCE TO RELATED APPLICATION

This application is a continuation-in-part of my copending U.S. patent application Ser. No. 003,813, filed Jan. 16, 1987, and now U.S. Pat. No. 4,716,749, for "High Security Pin Tumbler Lock."

BACKGROUND OF THE INVENTION

The present invention relates generally to tumbler locks and, more particularly, relates to an improved type of construction for pin tumbler locks which offers a heightened degree of resistance to picking.

FIELD OF THE INVENTION

A variety of tumbler locks, such as the well-known axial pin tubular locks, are currently available and are frequently used in applications such as vending machines which are installed in locations susceptible to picking attempts and other forms of surreptitious entry. It hence is a primary concern to design such tumbler locks in a fashion making them highly resistant to picking attempts.

Axial pin tubular locks, for instance, are conventionally based upon a design including a tubular sleeve within which a locking spindle is rotatably mounted and is normally prevented from rotation by axially movable tumbler pins which extend between the sleeve and an adjacent rigidly anchored driver spindle. The driver pins are usually of different lengths and, when actuated by using a proper key, axially displace the tumbler pins through different predetermined distances in such a manner that all the tumbler pins are precisely aligned at the shear plane between the locking spindle and the tumbler sleeve, thereby permitting the locking spindles to turn and bring about the locking action.

Although the use of several pins of different lengths provides such conventional tumbler locks with reasonable pick-resistant qualities, these locks can be picked by the use of small, specially shaped tools or probes that can be inserted into the keyway and used to manipulate the driver pins against corresponding tumbler pins so as to lock the driver pins against the tumbler pin edges due to the slight lateral movement or "give" available at the shear plane. This allows the locking spindle and hence the lock mechanism itself to rotate thereby defeating the tumbler lock. Many conventional tumbler locks are also susceptible to decoding techniques in which thin elongated tools are used to move the tumbler pins so as to determine by feel the position of each tumbler pin when it is at the shear line or otherwise at the spindle-rotating position.

Some tumbler locks utilized grooves defined on the tumbler pins that bind with corresponding flanges defined internally on the cylinder body of the lock when picking is attempted. Such locks generally necessitate complicated design and construction of the cylindrical lock body. For instance, the Huck Pin lock from Builders Hardware Industries incorporates a series of lands and grooves around some of the lower portion of the top pins and the upper top portion of the some of the lower pins which cause the pins to bind on a flange surrounding the lower portion of the cylinder pin housing when the lock is subjected to a picking attempt. (See Self et al., Technical Memorandum No. M-64-79-02, Naval Construction Battalion Center, California, pp. 11,12.)

Other tumbler locks, such as those using side bar engagement or rim and mortise cylinders, do provide increased pick resistance but incorporate complex locking mechanisms which invariably add substantially to the overall cost.

SUMMARY OF THE INVENTION

It is the general aim of the present invention to provide an improved tumbler lock construction which is highly resistant to picking attempts.

A related object is to provide an improved tumbler lock which is based on an uncomplicated locking mechanism and which can be economically manufactured. Specifically, the present invention may be produced by die casting or sintering.

It is a further object of this invention to provide an improved pin tumbler lock of the above type which is substantially of the same size and comprises about the same number of mechanical components as conventional tumbler locks.

These and other objects of this invention are realized by providing either or both the rear face of a driver sleeve and the front face of a stationary tumbler sleeve with undercut portions essentially providing false feels of a shear plane as driver pins are manipulated in an attempt to pick the lock. The undercut portions are preferably formed by a plurality of notches, each notch surrounding the driver and tumbler bores of the respective sleeves so as to provide at the trough of the notch a false shear plane while the crest of the notch portion of the tumbler and driver sleeve forms a plane which supports relatively thin discs staked to the sleeves which at their interface, form the true shear plane. The side of each disc which is adjacent the notches, also forms a potential false shear plane. Thus when attempting to pick the lock, and the driver and tumbler pins are at any of the edges of the notched false shear planes, the spindle and driver sleeve will not be able to turn because the pins will be caught in edges at the trough of the notch or on the underside of the disc. In addition, several of the driver pins, as well as the tumbler pins themselves, are provided with annular undercuts which, in combination with the undercuts provided by the disc and notches on the spindle and tumbler sleeves, accentuate the false feel effect. The different lengths of the driver pins in effect cause the undercuts on the driver and tumbler pins to co-act with the edges of undercuts provided on the spindle driver sleeve and tumbler sleeve in such a way that the false feel is effectuated at different inwardly extending positions of the driver pins, thereby making it practically impossible to determine when a particular tumbler pin has been precisely positioned at the shear plane.

The illustrative lock construction is uncomplicated and economical and can easily be incorporated into the design of conventional pin tumbler locks. One important aspect of the present invention is that notches on the driver or stationary tumbler sleeve may be manufactured economically by die casting or sintering. Since the shear plane includes a hardened metal disc, wear on the softer die cast tumbler and driver sleeve is minimized.

BRIEF DESCRIPTION OF THE DRAWINGS

The invention and further objects and advantages thereof will be made apparent by reference to the ensuing description when taken in conjunction with the accompanying drawings, wherein:

FIG. 1 is an exploded perspective view of certain important components of the tumbler lock according to the preferred embodiment of this invention.

FIG. 2 is a front elevational view of a tubular axial pin tumbler lock constructed according to the preferred embodiment of this invention.

FIG. 3 is a cross-sectional view taken substantially along the line 3—3 of FIG. 2.

DESCRIPTION OF THE PREFERRED EMBODIMENT

Figure 4:
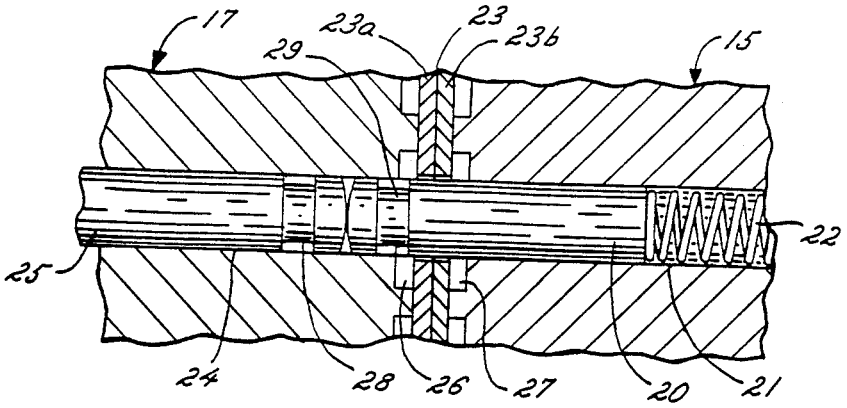
FIG. 4 is a magnified cross-sectional isolated view of the contact area between a driver and the corresponding tumbler pin and illustrating clearly the undercuts provided according to this invention.

Referring collectively now to drawings 1–3, there is shown an axial pin tumbler lock construction in accordance with a preferred embodiment of this invention. The tumbler lock includes an outer tubular body 11 which is adapted to be threaded into a support member 12 and includes a frustoconical head 13. A washer 14 is interspersed between the member 12 and the lock head 13 and functions to mount the lock assembly rigidly onto the mounting surface. A stationary tumbler sleeve 15 telescopes into and is rigidly anchored within the rear end of the tubular body 11. An elongated spindle 16 is rotatably supported in the tumbler sleeve 15 and extends through the lock body. A driver pin sleeve 17 is located at the forward end of the rotating spindle 16 and a locking member 18 is fastened into position after being inserted through the cross-section of the rear end of the spindle 16.

Actual locking and unlocking action of the lock is brought about by the rotating motion of the spindle which in turn causes the locking member 18 to move between a locked and unlocked position. Rotational movement of the spindle 16 is normally effected by using a key (not shown) adapted to fit into the frustoconical head 13 over the spindle and having a tab which aligns with a keyway 19 provided on the head of the lock.

A series of annularly spaced tumbler pins 20 (FIGS. 1 and 3) are slidably positioned within bores 21 defined through the tumbler sleeve 15 and function to normally retain the spindle 16 in its locked position wherein rotational motion is prohibited. The tumbler pins 20 are invariably urged forward by means of coiled compression springs 22 disposed within the bores 21 which retain the pins. Under the urging of the springs 22, the tumbler pins 20 are disposed along the bores 21 in such a manner that the outer ends of the pins normally project outward beyond the shear plane 23 formed at the interface of two matching discs **23*a* and 23*b* and into corresponding bores 24 defined through the driver sleeve. In this normal position, the tumbler pins lock the driver sleeve 17 and the spindle 16 against rotational motion relative to the tumbler sleeve 15**.

However, such rotational motion is permitted if the tumbler pins are displaced rearwardly against the urging of the compression springs in such a fashion that the forward ends of all the tumbler pins lie exactly at the sheer plane 23. This rearward displacement of the tumbler pins is effected by driver pins 25 positioned in an axially slidable manner within the bores 24 of the driver sleeve in such a way that the inner ends of the driver pins engage with the outer ends of the corresponding tumbler pins. Generally, at least some of the driver pins are of different lengths so that alignment of all tumbler pins at the sheer plane necessarily requires the displacement of different driver pins by different predetermined distances. This requires the use of a properly coded key to displace the driver pins through the predetermined distances in order to cause the rear ends of all of the tumbler pins to be simultaneously aligned at the sheer plane so that the spindle may be rotated. Coding of such conventional tumbler locks is accomplished by placing driver pins 25 of different lengths inside predetermined ones of the bores 23 defined in the driver sleeve 17.

The tumbler lock described so far is fairly conventional and can be picked by inserting a thin flexible probe through one of the bores of the driver sleeve in order to push the driver pin disposed therein, and consequently the corresponding tumbler pin backward while simultaneously applying a slight twisting force to the driver spindle and feeling for the slight edge presented by the junction of the driver pin and the tumbler pin at the shear plane and then gently locking the driver pin in this position. Even if it is not possible to pick the lock by locking the driver pin at the sheer plane, it is possible to decode the lock by estimating the length of a particular driver pin by carefully feeling for the edge or slight "give" resulting from the movement of the head of the driver pin in the immediate vicinity of the shear plane. The locking mechanism of such tumbler locks can hence be defeated by repeating the above procedure on the rest of the driver pins.

According to a unique feature of this invention, increased resistance to such attempts at picking or decoding the locking mechanism is made possible by constructing the locking components in such a way that a series of false feels or indications of the existence of the shear plane are provided as the driver pins are pushed backward in an attempt to pick the lock. Likewise, such false feels are provided if the attempt is made to "back pick" by pushing the pins all the way down and seeking to find the shear plane in the upward pin travel.

More specifically, at least one of either the rear face of the driver sleeve or the front face of the tumbler sleeve are provided with undercuts formed by providing notch portions on each side of the driver and tumbler axial bores so as to include, on the trough of the notch, edges which give a false shear plane while the notch crest portions of the tumbler and driver sleeve support matching discs which at their interface, form the true shear plane. The underside of each disc which is adjacent the notches, also presents edges that form a false shear plane. Thus when attempting to pick the lock, and aligning the driver and tumbler pins at any of the false shear planes, the spindle and driver sleeve will not be able to turn because the pins will be caught at an edge in the trough of the notch or on an edge at the underside of a disc. This novel construction, according to the system of this invention, is clearly illustrated in FIGS. 1 and 4 illustrating the notches 26 on the rear face of the spindle driver sleeve and notches 27 on the front face of the tumbler sleeve. The discs **23*a*, 23*b* which form the shear plane 23** are staked to the respective driver and tumbler sleeves. It will be appreciated that with the present arrangement, when the discs are staked to the respective sleeves there is also provided the ability to precisely size the assembly for the pin lengths used in the lock.

When conventionally shaped driver pins and tumbler pins are used with such a notch and disc arrangement, the discontinuities or edges provide a slight displacement of a driver or tumbler pin as the pin encounters the discontinuity during its axial motion. This effectively provides the false feel of a shear plane to a person attempting to pick the lock. This false feel effect is further accentuated, according to this invention, by providing annular grooves on the driver and tumbler pins. More specifically, as shown in FIG. 4, the driver pin 25 is provided with an annular groove 28 proximate to its end that cooperates with the tumbler pin 20. In addition, the tumbler pin 20 is also provided with a similar annular groove 29 on its end cooperating with the driver pin 25. As the driver pin 25 is moved axially inwards so as to push the tumbler pin 20 inwards against the pre-tensioning effect of the compression spring 22, the annular grooves 28 and 29 cooperate with the spindle notches so as to increase the extent of "give" between the pins and the bore discontinuity presented by the notches, thereby giving the false impression that the shear plane 23 exists in the vicinity of the trough of the notch. As the inward displacement of the driver pin 25 and tumbler pin 20 continues, the pin grooves 28 and 29 traverse the true shear plane 23 and subsequently interact with the tumbler notches to again increase the extent of "give" so as to provide a second false impression that the shear plane 23 lies in the vicinity of the notches.

In the preferred embodiment, the annular grooves are provided on several of the driver pins as well as tumbler pins and the different lengths of the driver pins used to code the lock in effect cause grooves on the driver and tumbler pins to co-act with the notches on the spindle and the tumbler sleeve in such a manner that the false feel of the shear plane is provided at different inwardly extending positions of the driver and tumbler pins, thereby making it virtually impossible to determine exactly the true position of the shear plane.

According to a feature of this invention, the above type of lock construction incorporating the notches for the tumbler sleeve provides a simple and economical alternative to the expensive and possibly unfeasible molding or boring operations that would otherwise be necessary to define an annular undercut inside an integrally formed tumbler sleeve which would provide a false feel.

Figure 5:
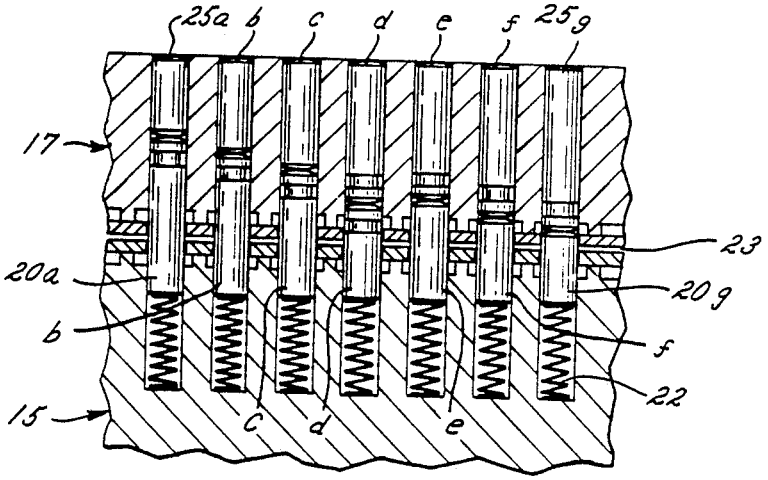
FIG. 5 is a cross-sectional view illustrating the disposition of a plurality of grooved pins according to this invention.

It will be apparent that varying combinations of grooved and ungrooved driver and tumbler pins may be provided to present the false feel of the shear plane in a manner that appears seemingly random to a person attempting to pick or decode the lock. A typical example of one such combination is provided in FIG. 5, where driver pins 25*a*, 25*b*, 25*c*, and 25*d* are provided with annular grooves whereas the remaining driving pins 25*e*, 25*f* and 25*g* are of conventional cylindrical shape. On the tumbler sleeve end, the tumbler pins 20*a*, 20*b* and 20*c* are of conventional cylindrical shape whereas the pins 20*d*, 20*e*, 20*f* and 20*g* are provided with the annular grooves. It is preferable that at least one set of pins comprising a driver pin and the corresponding tumbler pin be provided with annular grooves on both the driver and the tumbler pins and indeed security is increased as more of the annular grooves are used on the pin sets; for instance, in FIG. 5 the driver pin 25*d* and the corresponding tumbler pin 20*d* are both provided with annular grooves.

From the foregoing it is quire apparent that the present invention provides an improved tumbler lock construction which is highly resistant to picking attempts and is based on an uncomplicated locking mechanism which can be economically manufactured.

What is claimed is:

1. In a tubular lock construction comprising an outer barrel having forward and rear ends, a stationary tumbler sleeve telescoped into the rear end portion of said barrel, a locking spindle extending through and rotatably mounted in said stationary tumbler sleeve, a rotatable driver sleeve fixed to said spindle and disposed within said barrel in face-to-face relation with the forward end of said stationary tumbler sleeve and driver and tumbler pins slidably mounted in axially extending and angularly spaced bores defined in said stationary tumbler sleeve and said rotatable driver sleeve and normally operable to prevent rotation of said spindle with respect to said stationary tumbler sleeve, the improvement comprising at least one of the rear face of said driver sleeve and a front face of said tumbler sleeve is provided with a plurality of notches, each notch surrounding an axial bore so as to provide a false shear plane at a trough of the notch and a support plane at the crests of said notches, said ones of said sleeves including the notched face having a relatively thin disc member fixedly mounted on the notch crests, said disc having annularly spaced bores corresponding to the tumbler and driver sleeve bores; and annular grooves defined on selected ones of said driver pins and said tumbler pins at their end proximate to the face-to-face junction of said sleeves, whereby said pin grooves interact with said sleeve notches and disc to create a false impression of the existence of said face-to-face junction, as the pins are axially slided along said annular bores.

2. The tubular lock construction of claim 1 wherein said annular pin grooves are defined about the pin ends proximate to said face-to-face junction of said tumbler sleeve disc and said driver sleeve disc.

3. The tubular construction of claim 2 wherein at least one pair of pins comprising a selected driver pin and the corresponding tumbler pin is provided with the annular grooves.

4. The tubular lock construction of claim 1 wherein each axial bore of the notched sleeve is surrounded by a notch trough.

5. The tubular lock construction of claim 1 wherein each axial bore has a notch crest between it and the next axial bore.

6. The tubular lock construction of claim 1 wherein the plurality of notches include troughs of the same depths.

7. The tubular lock of claim 1 wherein said driver sleeve includes the notched face and a disc member.

8. The tubular lock of claim 1 wherein said tumbler sleeve includes the notched face and a disc member.

9. In a tubular lock construction comprising an outer barrel having forward and rear ends, a stationary tumbler sleeve telescoped into the rear end portion of said barrel, a locking spindle extending through and rotatably mounted in said stationary tumbler sleeve, a rotatable driver sleeve fixed to said spindle and disposed within said barrel in face-to-face relation with the forward end of said stationary tumbler sleeve and driver and tumbler pins slidably mounted in axially extending and angularly spaced bores defined in said stationary tumbler sleeve and said rotatable driver sleeve and normally operable to prevent rotation of said spindle with respect to said stationary tumbler sleeve, the improvement comprising both the rear face of said driver sleeve and a front face of said tumbler sleeve are provided with a plurality of notches, each notch surrounding the axial bore so as to provide a false shear plane at a trough of the notch and a support plane at the crests of said notches, said faces of each sleeve including the notched face having a relatively thin disc member fixedly mounted on the notch crests, said disc having annularly spaced bores corresponding to the tumbler and driver sleeve bores; and annular grooves defined on selected ones of said driver pins and said tumbler pins at their end proximate to the face-to-face junction of said sleeves, whereby said pin grooves interact with said sleeve notches and disc to create a false impression of the existence of said face-to-face junction, as the pins are axially slided along said annular bores.

10. The tubular lock construction of claim 9 wherein said annular pin grooves are defined about the pin ends proximate to said face-to-face junction of said tumbler sleeve disc and said driver sleeve disc.

11. The tubular construction of claim 9 wherein at least one pair of pins comprising a selected driver pin and the corresponding tumbler pin is provided with the annular grooves.

12. The tubular lock construction of claim 9 wherein each axial bore of the notched sleeve is surrounded by a notch trough.

13. The tubular lock construction of claim 9 wherein each axial bore has a notch crest between it and the next axial bore.

14. The tubular lock construction of claim 9 wherein the plurality of notches include troughs of the same depths.

* * * * *